US010207516B2

(12) United States Patent
Govyadinov et al.

(10) Patent No.: US 10,207,516 B2
(45) Date of Patent: Feb. 19, 2019

(54) FLUID EJECTION DEVICE

(71) Applicant: HEWLETT-PACKARD DEVELOPMENT COMPANY, L.P., Fort Collins, CO (US)

(72) Inventors: Alexander Govyadinov, Corvallis, OR (US); Tsuyoshi Yamashita, Corvallis, OR (US); Erik D Torniainen, Corvallis, OR (US)

(73) Assignee: HEWLETT PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/546,808

(22) PCT Filed: Apr. 30, 2015

(86) PCT No.: PCT/US2015/028665
§ 371 (c)(1),
(2) Date: Jul. 27, 2017

(87) PCT Pub. No.: WO2016/175865
PCT Pub. Date: Nov. 3, 2016

(65) Prior Publication Data

US 2018/0022106 A1 Jan. 25, 2018

(51) Int. Cl.
*B41J 2/18* (2006.01)
*B41J 2/14* (2006.01)
*B41J 2/175* (2006.01)

(52) U.S. Cl.
CPC ..... *B41J 2/18* (2013.01); *B41J 2/1404* (2013.01); *B41J 2/14056* (2013.01);
(Continued)

(58) Field of Classification Search
CPC combination set(s) only.
See application file for complete search history.

(56) References Cited

U.S. PATENT DOCUMENTS 6,244,694 B1 6/2001 Weber et al.
6,554,408 B1 4/2003 Miki et al.
(Continued)

FOREIGN PATENT DOCUMENTS

CN 102036829 4/2011
CN 103442896 12/2013
(Continued)

OTHER PUBLICATIONS

Li, Xiaoran, "Ink-Jet Patterning of Functional Materials: State of the Art and Prospect", Topmaster in Nanoscience 2006-2008, Jun. 1, 2007, 23 pgs.

*Primary Examiner* — Matthew Luu
*Assistant Examiner* — Lily Kemathe
(74) *Attorney, Agent, or Firm* — HP Inc.—Patent Department

(57) ABSTRACT

A fluid ejection device includes a fluid slot, a first fluid ejection chamber communicated with the fluid slot and including a first drop ejecting element, a second fluid ejection chamber including a second drop ejecting element, and a fluid circulation path including a first portion communicated with the fluid slot and the second fluid ejection chamber, and a second portion communicated with the first fluid ejection chamber and the second fluid ejection chamber, with the fluid circulation path including a fluid circulating element within the first portion.

20 Claims, 8 Drawing Sheets

(52) U.S. Cl.
CPC ..... *B41J 2/14153* (2013.01); *B41J 2/175* (2013.01); *B41J 2002/14354* (2013.01); *B41J 2002/14403* (2013.01); *B41J 2002/14467* (2013.01); *B41J 2202/12* (2013.01)

(56) References Cited

U.S. PATENT DOCUMENTS

| | | | | |
|---|---|---|---|---|
| 8,721,061 | B2 * | 5/2014 | Govyadinov | B41J 2/14233 347/65 |
| 8,752,946 | B2 | 6/2014 | Wells, Jr. et al. | |
| 8,757,783 | B2 * | 6/2014 | Govyadinov | B41J 2/1404 347/67 |
| 8,814,293 | B2 * | 8/2014 | Strunk | B41J 2/175 347/6 |
| 8,820,899 | B2 * | 9/2014 | Hoisington | B41J 2/14233 347/68 |
| 8,870,325 | B2 | 10/2014 | Mardilovich et al. | |
| 8,894,182 | B2 * | 11/2014 | Osaki | B41J 2/1404 347/44 |
| 8,939,531 | B2 * | 1/2015 | Govyadinov | B41J 2/14129 347/9 |
| 9,090,084 | B2 * | 7/2015 | Govyadinov | B41J 2/1404 |
| 9,108,425 | B2 * | 8/2015 | Kashu | B41J 2/1404 |
| 9,156,262 | B2 * | 10/2015 | Taff | B41J 2/1404 |
| 9,211,721 | B2 * | 12/2015 | Govyadinov | B41J 2/175 |
| 9,283,590 | B2 * | 3/2016 | Govyadinov | B41J 2/175 |
| 9,315,019 | B2 * | 4/2016 | Govyadinov | B41J 2/14016 |
| 9,381,739 | B2 * | 7/2016 | Govyadinov | B41J 2/04541 |
| 9,457,584 | B2 * | 10/2016 | Govyadinov | B41J 2/175 |
| 9,604,212 | B2 * | 3/2017 | Govyadinov | B41J 2/1404 |
| 9,623,659 | B2 * | 4/2017 | Govyadinov | B41J 2/175 |
| 9,901,952 | B2 * | 2/2018 | Govyadinov | B41J 2/175 |
| 2001/0043243 | A1 | 11/2001 | Tachihara et al. | |
| 2002/0024567 | A1 | 2/2002 | Takagi et al. | |
| 2011/0128335 | A1 | 6/2011 | Von Essen et al. | |
| 2012/0007921 | A1 | 1/2012 | Govyadinov et al. | |
| 2012/0113197 | A1 | 5/2012 | Kashu et al. | |
| 2013/0076835 | A1 | 3/2013 | Oikawa et al. | |
| 2013/0083136 | A1 | 4/2013 | Govyadinov | |
| 2013/0155152 | A1 | 6/2013 | Govyadinov | |
| 2013/0278688 | A1 | 10/2013 | Bibl | |
| 2014/0204148 | A1 | 7/2014 | Ge et al. | |
| 2014/0362143 | A1 | 11/2014 | Govyadinov | |
| 2015/0049141 | A1 * | 2/2015 | Taff | B41J 2/1404 347/54 |
| 2015/0091989 | A1 * | 4/2015 | Govyadinov | B41J 2/04541 347/89 |
| 2015/0273853 | A1 * | 10/2015 | Govyadinov | B41J 2/1404 347/89 |
| 2016/0159102 | A1 * | 6/2016 | Kaneko | B41J 2/04563 347/10 |
| 2017/0151807 | A1 * | 6/2017 | Govyadinov | B41J 2/1404 |
| 2017/0197419 | A1 * | 7/2017 | Okushima | B41J 2/1433 |
| 2017/0305169 | A1 * | 10/2017 | Govyadinov | B41J 2/175 |
| 2017/0313063 | A1 * | 11/2017 | Govyadinov | B41J 2/175 |

FOREIGN PATENT DOCUMENTS

| | | |
|---|---|---|
| CN | 103619605 | 3/2014 |
| WO | WO-2014003772 | 1/2014 |
| WO | WO-2014084843 | 6/2014 |

* cited by examiner

FLUID EJECTION DEVICE

BACKGROUND

Fluid ejection devices, such as printheads in inkjet printing systems, may use thermal resistors or piezoelectric material membranes as actuators within fluidic chambers to eject fluid drops (e.g., ink) from nozzles, such that properly sequenced ejection of ink drops from the nozzles causes characters or other images to be printed on a print medium as the printhead and the print medium move relative to each other.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure.

Figure 1:
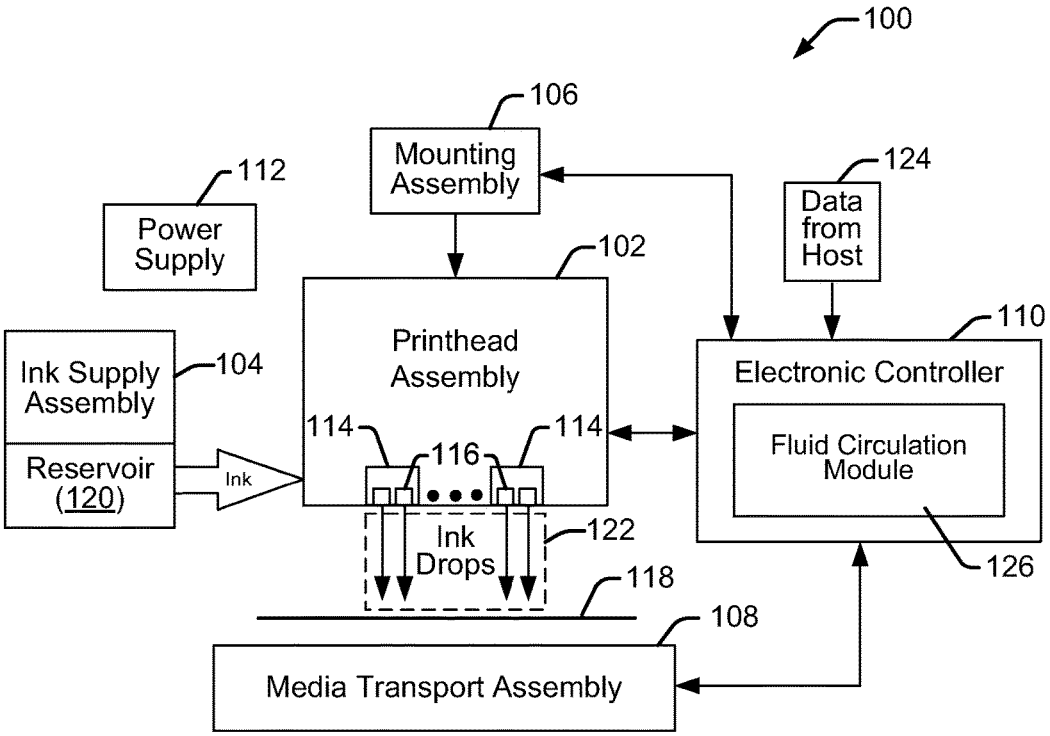
FIG. 1 is a block diagram illustrating one example of an inkjet printing system including an example of a fluid ejection device.

FIG. 1 illustrates one example of an inkjet printing system as an example of a fluid ejection device with fluid circulation, as disclosed herein. Inkjet printing system 100 includes a printhead assembly 102, an ink supply assembly 104, a mounting assembly 106, a media transport assembly 108, an electronic controller 110, and at least one power supply 112 that provides power to the various electrical components of inkjet printing system 100. Printhead assembly 102 includes at least one fluid ejection assembly 114 (printhead 114) that ejects drops of ink through a plurality of orifices or nozzles 116 toward a print medium 118 so as to print on print media 118.

Print media 118 can be any type of suitable sheet or roll material, such as paper, card stock, transparencies, Mylar, and the like. Nozzles 116 are typically arranged in one or more columns or arrays such that properly sequenced ejection of ink from nozzles 116 causes characters, symbols, and/or other graphics or images to be printed on print media 118 as printhead assembly 102 and print media 118 are moved relative to each other.

Ink supply assembly 104 supplies fluid ink to printhead assembly 102 and, in one example, includes a reservoir 120 for storing ink such that ink flows from reservoir 120 to printhead assembly 102. Ink supply assembly 104 and printhead assembly 102 can form a one-way ink delivery system or a recirculating ink delivery system. In a one-way ink delivery system, substantially all of the ink supplied to printhead assembly 102 is consumed during printing. In a recirculating ink delivery system, only a portion of the ink supplied to printhead assembly 102 is consumed during printing. Ink not consumed during printing is returned to ink supply assembly 104.

In one example, printhead assembly 102 and ink supply assembly 104 are housed together in an inkjet cartridge or pen. In another example, ink supply assembly 104 is separate from printhead assembly 102 and supplies ink to printhead assembly 102 through an interface connection, such as a supply tube. In either example, reservoir 120 of ink supply assembly 104 may be removed, replaced, and/or refilled. Where printhead assembly 102 and ink supply assembly 104 are housed together in an inkjet cartridge, reservoir 120 includes a local reservoir located within the cartridge as well as a larger reservoir located separately from the cartridge. The separate, larger reservoir serves to refill the local reservoir. Accordingly, the separate, larger reservoir and/or the local reservoir may be removed, replaced, and/or refilled.

Mounting assembly 106 positions printhead assembly 102 relative to media transport assembly 108, and media transport assembly 108 positions print media 118 relative to printhead assembly 102. Thus, a print zone 122 is defined adjacent to nozzles 116 in an area between printhead assembly 102 and print media 118. In one example, printhead assembly 102 is a scanning type printhead assembly. As such, mounting assembly 106 includes a carriage for moving printhead assembly 102 relative to media transport assembly 108 to scan print media 118. In another example, printhead assembly 102 is a non-scanning type printhead assembly. As such, mounting assembly 106 fixes printhead assembly 102 at a prescribed position relative to media transport assembly 108. Thus, media transport assembly 108 positions print media 118 relative to printhead assembly 102.

Electronic controller 110 typically includes a processor, firmware, software, one or more memory components including volatile and non-volatile memory components, and other printer electronics for communicating with and controlling printhead assembly 102, mounting assembly 106, and media transport assembly 108. Electronic controller 110 receives data 124 from a host system, such as a computer, and temporarily stores data 124 in a memory. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one example, electronic controller 110 controls printhead assembly 102 for ejection of ink drops from nozzles 116. Thus, electronic controller 110 defines a pattern of ejected ink drops which form characters, symbols, and/or other graphics or images on print media 118. The pattern of ejected ink drops is determined by the print job commands and/or command parameters.

Printhead assembly 102 includes one or more printheads 114. In one example, printhead assembly 102 is a wide-array or multi-head printhead assembly. In one implementation of a wide-array assembly, printhead assembly 102 includes a carrier that carries a plurality of printheads 114, provides electrical communication between printheads 114 and electronic controller 110, and provides fluidic communication between printheads 114 and ink supply assembly 104.

In one example, inkjet printing system 100 is a drop-on-demand thermal inkjet printing system wherein printhead 114 is a thermal inkjet (TIJ) printhead. The thermal inkjet printhead implements a thermal resistor ejection element in an ink chamber to vaporize ink and create bubbles that force ink or other fluid drops out of nozzles 116. In another example, inkjet printing system 100 is a drop-on-demand piezoelectric inkjet printing system wherein printhead 114 is a piezoelectric inkjet (PIJ) printhead that implements a piezoelectric material actuator as an ejection element to generate pressure pulses that force ink drops out of nozzles 116.

In one example, electronic controller 110 includes a flow circulation module 126 stored in a memory of controller 110. Flow circulation module 126 executes on electronic controller 110 (i.e., a processor of controller 110) to control the operation of one or more fluid actuators integrated as pump elements within printhead assembly 102 to control circulation of fluid within printhead assembly 102.

Figure 2:
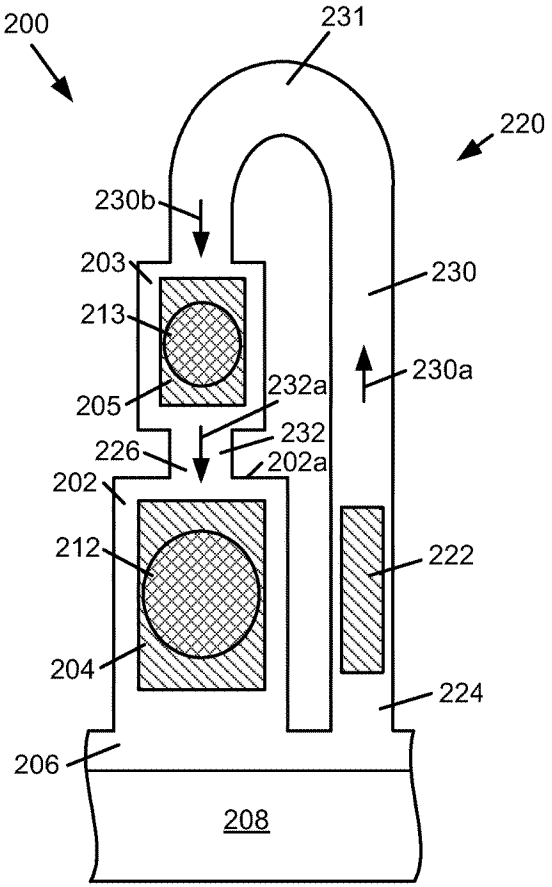
FIG. 2 is a schematic plan view illustrating an example of a portion of a fluid ejection device.

FIG. 2 is a schematic plan view illustrating an example of a portion of a fluid ejection device 200. Fluid ejection device 200 includes a first fluid ejection chamber 202 and a corresponding drop ejecting element 204 formed in, provided within, or communicated with fluid ejection chamber 202, and a second fluid ejection chamber 203 and a corresponding drop ejecting element 205 formed in, provided within, or communicated with fluid ejection chamber 203.

In one example, fluid ejection chambers 202 and 203 and drop ejecting elements 204 and 205 are formed on a substrate 206 which has a fluid (or ink) feed slot 208 formed therein such that fluid feed slot 208 provides a supply of fluid (or ink) to fluid ejection chambers 202 and 203 and drop ejecting elements 204 and 205. Fluid feed slot 208 includes, for example, a hole, passage, opening, convex geometry or other fluidic architecture formed in or through substrate 206 by which or through which fluid is supplied to fluid ejection chambers 202 and 203, and may include one (i.e., a single) or more than one (e.g., a series of) such hole, passage, opening, convex geometry or other fluidic architecture that communicates fluid with one (i.e., a single) or more than one fluid ejection chamber, and may be of circular, non-circular, or other shape. Substrate 206 may be formed, for example, of silicon, glass, or a stable polymer.

In one example, fluid ejection chambers 202 and 203 are formed in or defined by a barrier layer (not shown) provided on substrate 206, such that fluid ejection chambers 202 and 203 each provide a "well" in the barrier layer. The barrier layer may be formed, for example, of a photoimageable epoxy resin, such as SU8.

In one example, a nozzle or orifice layer (not shown) is formed or extended over the barrier layer such that nozzle openings or orifices 212 and 213 formed in the orifice layer communicate with respective fluid ejection chambers 202 and 203. Nozzle openings or orifices 212 and 213 may be of a circular, non-circular, or other shape. Although illustrated as being of the same shape, nozzle openings or orifices 212 and 213 may be of different shapes (for example, one circular, one non-circular).

In the example illustrated in FIG. 2, nozzle openings or orifices 212 and 213 are of different sizes (for example, different diameters, effective diameters, or maximum dimensions). Providing nozzle openings or orifices 212 and 213 with different sizes enables ejection of different drop sizes (weights) from respective fluid ejection chambers 202 and 203. In addition, drop ejecting elements 204 and 205 may be operated separately or individually at different moments of time (for example, sequentially) to produce drops of different sizes (weights), or operated simultaneously to produce a combined drop of a combined size (weight). Although illustrated as being of different sizes, nozzle openings or orifices 212 and 213 may be of the same size.

Drop ejecting elements 204 and 205 can be any device capable of ejecting fluid drops through corresponding nozzle openings or orifices 212 and 213. Examples of drop ejecting elements 204 and 205 include thermal resistors or piezoelectric actuators. A thermal resistor, as an example of a drop ejecting element, is typically formed on a surface of a substrate (substrate 206), and includes a thin-film stack including an oxide layer, a metal layer, and a passivation layer such that, when activated, heat from the thermal resistor vaporizes fluid in corresponding fluid ejection chamber 202 or 203, thereby causing a bubble that ejects a drop of fluid through corresponding nozzle opening or orifice 212 or 213. A piezoelectric actuator, as an example of a drop ejecting element, generally includes a piezoelectric material provided on a movable membrane communicated with corresponding fluid ejection chamber 202 or 203 such that, when activated, the piezoelectric material causes deflection of the membrane relative to corresponding fluid ejection chamber 202 or 203, thereby generating a pressure pulse that ejects a drop of fluid through corresponding nozzle opening or orifice 212 or 213.

As illustrated in the example of FIG. 2, fluid ejection device 200 includes a fluid circulation path or channel 220 and a fluid circulating element 222 formed in, provided within, or communicated with fluid circulation channel 220. Fluid circulation channel 220 is open to and communicates at one end 224 with fluid feed slot 208 and is open to and communicates at another end 226 with fluid ejection chamber 202.

In one example, end 226 of fluid circulation channel 220 communicates with fluid ejection chamber 202 at an end 202*a* of fluid ejection chamber 202. In one example, fluid ejection chamber 203 is provided in, provided along, or communicated with fluid circulation channel 220 between end 224 and end 226. More specifically, in one example, fluid ejection chamber 203 is provided in, provided along, or communicated with fluid circulation channel 220 between fluid circulating element 222 and fluid ejection chamber 202. In one example, and as further described below, a position of fluid ejection chamber 203 may vary along fluid circulation channel 220.

Fluid circulating element 222 forms or represents an actuator to pump or circulate (or recirculate) fluid through fluid circulation channel 220. As such, fluid from fluid feed slot 208 circulates (or recirculates) through fluid circulation channel 220 and fluid ejection chambers 202 and 203 based on flow induced by fluid circulating element 222. In one example, circulating (or recirculating) fluid through fluid ejection chambers 202 and 203 helps to reduce ink blockage and/or clogging in fluid ejection device 200.

In the example illustrated in FIG. 2, drop ejecting elements 204 and 205 and fluid circulating element 222 are each thermal resistors. Each of the thermal resistors may include, for example, a single resistor, a split resistor, a comb resistor, or multiple resistors. A variety of other devices, however, can also be used to implement drop ejecting elements 204 and 205 and fluid circulating element 222 including, for example, a piezoelectric actuator, an electrostatic (MEMS) membrane, a mechanical/impact driven membrane, a voice coil, a magneto-strictive drive, and so on.

In one example, fluid circulation channel 220 includes a path or channel portion 230 communicated with and extended between fluid feed slot 208 and fluid ejection chamber 203, and a path or channel portion 232 communicated with and extended between fluid ejection chamber 203 and fluid ejection chamber 202. As such, in one example, fluid in fluid circulation channel 220 circulates (or recirculates) between fluid feed slot 208 and fluid ejection chamber 203 through channel portion 230, and circulates (or recirculates) between fluid feed slot 208 and fluid ejection chamber 202 through channel portion 230 and channel portion 232, including through fluid ejection chamber 203.

In one example, fluid circulation channel 220 forms a fluid circulation (or recirculation) loop between fluid feed slot 208, fluid ejection chamber 203, and fluid ejection chamber 202. For example, fluid from fluid feed slot 208 circulates (or recirculates) through fluid circulation channel 220, through fluid ejection chamber 203, and through fluid ejection chamber 202 back to fluid feed slot 208. More specifically, fluid from fluid feed slot 208 circulates (or recirculates) through channel portion 230, through fluid ejection chamber 203, through channel portion 232, and through fluid ejection chamber 202 back to fluid feed slot 208.

In one example, channel portion 230 circulates (or recirculates) fluid in a first direction, as indicated by arrow 230*a*, and a second direction opposite the first direction, as indicated by arrow 230*b*. In addition, channel portion 232 circulates (or recirculates) fluid in the second direction, as indicated by arrow 232*a*. As such, in one example, fluid circulation channel 220 circulates fluid in a first direction (arrow 230*a*) between fluid circulating element 222 and fluid ejection chamber 203, and circulates fluid in a second direction (arrow 232*a*) opposite the first direction between fluid ejection chamber 203 and fluid ejection chamber 202, and circulates fluid in the first direction (arrow 230*a*) and the second direction (arrow 230*b*) between fluid circulating element 222 and fluid ejection chamber 203.

In one example, to provide fluid flow in the first direction indicated by arrow 230*a* and the second, opposite direction indicated by arrow 230*b*, channel portion 230 includes a channel loop 231. In one example, channel loop 231 includes a U-shaped portion of fluid circulation channel 220 such that a length (or portion) of channel portion 230 and a length (or portion) of channel portion 232 are spaced from and oriented substantially parallel with each other.

In one example, a width of channel portion 230 and a width of channel portion 232 are substantially equal. In addition, a length of channel portion 230 is greater than a length of channel portion 232. Furthermore, as illustrated in the example of FIG. 2, a width of channel portion 230 is less than a width of fluid ejection chamber 203, and a width of channel portion 232 is less than a width of fluid ejection chamber 203 and fluid ejection chamber 202. As such, channel portion 232 forms a restriction or "pinch" between fluid ejection chamber 203 and fluid ejection chamber 202. In one example, such restriction or "pinch" helps to mitigate cross-talk between fluid ejection chamber 203 and fluid ejection chamber 202.

Figure 3:
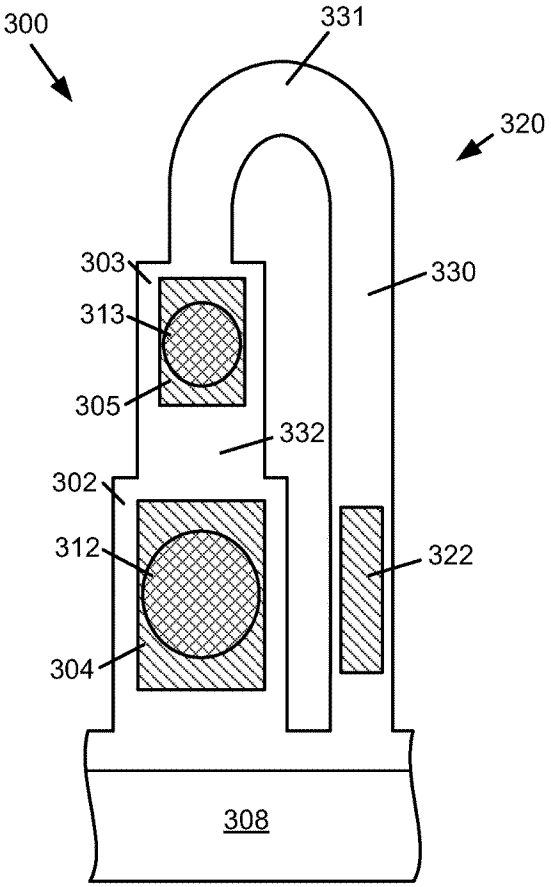
FIG. 3 is a schematic plan view illustrating an example of a portion of a fluid ejection device.

FIG. 3 is a schematic plan view illustrating an example of a portion of a fluid ejection device 300. Similar to fluid ejection device 200, fluid ejection device 300 includes a first fluid ejection chamber 302 with a corresponding drop ejecting element 304, and a second fluid ejection chamber 303 with a corresponding drop ejecting element 305, such that nozzle openings or orifices 312 and 313 communicate with respective fluid ejection chambers 302 and 303. In addition, in one example, fluid ejection device 300 includes a fluid circulation path or channel 320 with a corresponding fluid circulating element 322, with fluid circulation channel 320 including a path or channel portion 330 communicated with and extended between fluid feed slot 308 and fluid ejection chamber 303, and a path or channel portion 332 communicated with and extended between fluid ejection chamber 303 and fluid ejection chamber 302.

Similar to fluid circulation channel 220 of fluid ejection device 200, fluid circulation channel 320 of fluid ejection device 300 forms a fluid circulation (or recirculation) loop between fluid feed slot 308, fluid ejection chamber 303, and fluid ejection chamber 302. For example, fluid from fluid feed slot 308 circulates (or recirculates) through fluid circulation channel 320, through fluid ejection chamber 303, and through fluid ejection chamber 302 back to fluid feed slot 308. More specifically, fluid from fluid feed slot 308 circulates (or recirculates) through channel portion 330, through fluid ejection chamber 303, through channel portion 332, and through fluid ejection chamber 302 back to fluid feed slot 308. In one example, and similar to channel portion 230 of fluid ejection device 200, channel portion 330 includes a channel loop 331 wherein channel loop 331 includes a U-shaped portion of fluid circulation channel 320.

As illustrated in the example of FIG. 3, a width of channel portion 332 is greater than a width of channel portion 330. More specifically, in one example, a width of channel portion 332 is substantially the same as a width of fluid ejection chamber 303. As such, channel portion 332 provides for straight or "full width" communication between fluid ejection chamber 303 and fluid ejection chamber 302.

Figure 4:
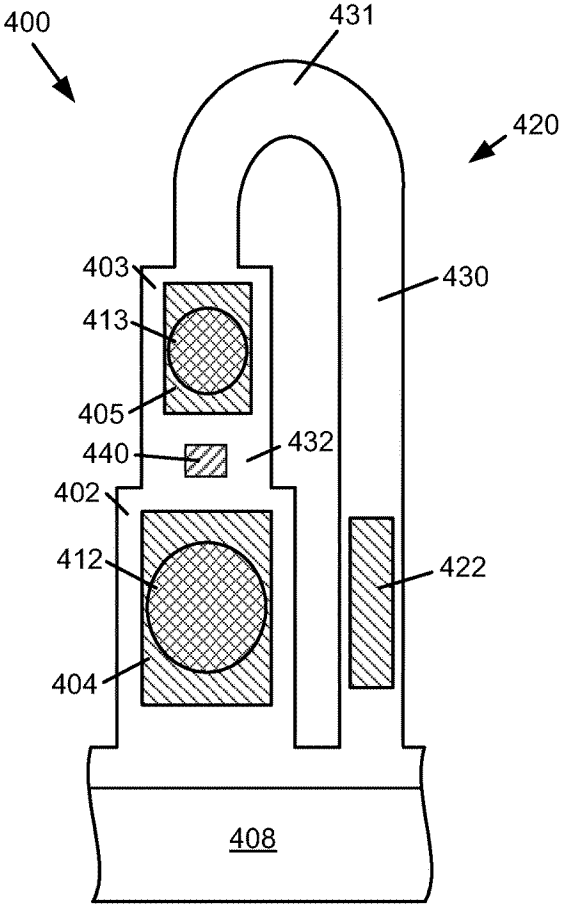
FIG. 4 is a schematic plan view illustrating an example of a portion of a fluid ejection device.

FIG. 4 is a schematic plan view illustrating an example of a portion of a fluid ejection device 400. Similar to fluid ejection device 300, fluid ejection device 400 includes a first fluid ejection chamber 402 with a corresponding drop ejecting element 404, and a second fluid ejection chamber 403 with a corresponding drop ejecting element 405, such that nozzle openings or orifices 412 and 413 communicate with respective fluid ejection chambers 402 and 403. In addition, in one example, fluid ejection device 400 includes a fluid circulation path or channel 420 with a corresponding fluid circulating element 422, with fluid circulation channel 420 including a path or channel portion 430 communicated with and extended between fluid feed slot 408 and fluid ejection chamber 403, and a path or channel portion 432 communicated with and extended between fluid ejection chamber 403 and fluid ejection chamber 402.

Similar to fluid circulation channel 320 of fluid ejection device 300, fluid circulation channel 420 of fluid ejection device 400 forms a fluid circulation (or recirculation) loop between fluid feed slot 408, fluid ejection chamber 403, and fluid ejection chamber 402. For example, fluid from fluid feed slot 408 circulates (or recirculates) through fluid circulation channel 420, through fluid ejection chamber 403, and through fluid ejection chamber 402 back to fluid feed slot 408. More specifically, fluid from fluid feed slot 408 circulates (or recirculates) through channel portion 430, through fluid ejection chamber 403, through channel portion 432, and through fluid ejection chamber 402 back to fluid feed slot 408. In one example, and similar to channel portion 330 of fluid ejection device 300, channel portion 430 includes a channel loop 431 wherein channel loop 431 includes a U-shaped portion of fluid circulation channel 420.

As illustrated in the example of FIG. 4, fluid ejection device 400 includes a particle tolerant architecture 440. Particle tolerant architecture 440 includes, for example, a pillar, a column, a post or other structure (or structures) formed in or provided within fluid circulation channel 420. In one example, particle tolerant architecture 440 is formed within fluid circulation channel 420 between fluid ejection chamber 403 and fluid ejection chamber 402.

In one example, particle tolerant architecture 440 forms an "island" in fluid circulation channel 420 which allows fluid to flow therearound and into fluid ejection chamber 402 while preventing particles, such as air bubbles or other particles (e.g., dust, fibers), from flowing into fluid ejection chamber 402 through fluid circulation channel 420. In addition, particle tolerant architecture 440 also helps to prevent air bubbles and/or other particles from entering fluid ejection chamber 403 from fluid ejection chamber 402. Such particles, if allowed to enter fluid ejection chamber 402 or fluid ejection chamber 403, may affect a performance of fluid ejection device 400. Furthermore, particle tolerant architecture 440 helps to increase back pressure and, therefore, increase firing momentum of the ejection of drops from fluid ejection chamber 402 or fluid ejection chamber 403 by helping to contain the drive energy of the drop ejection.

Figure 5:
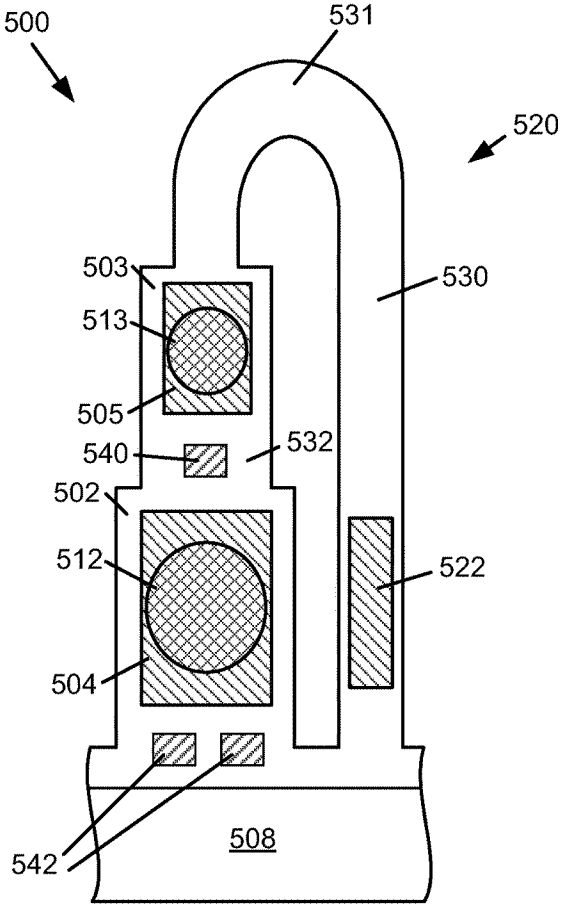
FIG. 5 is a schematic plan view illustrating an example of a portion of a fluid ejection device.

FIG. 5 is a schematic plan view illustrating an example of a portion of a fluid ejection device 500. Similar to fluid ejection device 400, fluid ejection device 500 includes a first fluid ejection chamber 502 with a corresponding drop ejecting element 504, and a second fluid ejection chamber 503 with a corresponding drop ejecting element 505, such that nozzle openings or orifices 512 and 513 communicate with respective fluid ejection chambers 502 and 503. In addition, in one example, fluid ejection device 500 includes a fluid circulation path or channel 520 with a corresponding fluid circulating element 522, with fluid circulation channel 520 including a path or channel portion 530 communicated with and extended between fluid feed slot 508 and fluid ejection chamber 503, and a path or channel portion 532 communicated with and extended between fluid ejection chamber 503 and fluid ejection chamber 502.

Similar to fluid circulation channel 420 of fluid ejection device 400, fluid circulation channel 520 of fluid ejection device 500 forms a fluid circulation (or recirculation) loop between fluid feed slot 508, fluid ejection chamber 503, and fluid ejection chamber 502. For example, fluid from fluid feed slot 508 circulates (or recirculates) through fluid circulation channel 520, through fluid ejection chamber 503, and through fluid ejection chamber 502 back to fluid feed slot 508. More specifically, fluid from fluid feed slot 508 circulates (or recirculates) through channel portion 530, through fluid ejection chamber 503, through channel portion 532, and through fluid ejection chamber 502 back to fluid feed slot 508. In one example, and similar to channel portion 430 of fluid ejection device 400, channel portion 530 includes a channel loop 531 wherein channel loop 531 includes a U-shaped portion of fluid circulation channel 520.

As illustrated in the example of FIG. 5, fluid ejection device 500 includes a particle tolerant architecture 540 within fluid circulation channel 520 between fluid ejection chamber 503 and fluid ejection chamber 502, and includes a particle tolerant architecture 542 between fluid feed slot 508 and fluid ejection chamber 502. Particle tolerant architecture 540 and particle tolerant architecture 542 include, for example, a pillar, a column, a post or other structure (or structures). As such, particle tolerant architecture 540 and particle tolerant architecture 542 form "islands" which allow fluid to flow therearound while preventing particles, such as air bubbles or other particles (e.g., dust, fibers), from flowing into fluid ejection chamber 502 through fluid circulation channel 520, into fluid ejection chamber 503 from fluid ejection chamber 502, and into fluid ejection chamber 502 from fluid feed slot 508.

Figure 6:
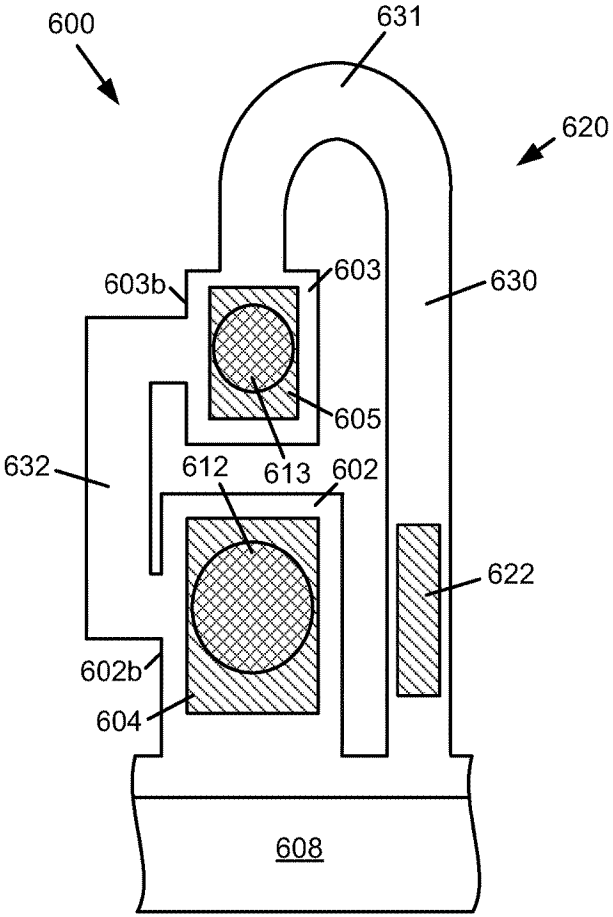
FIG. 6 is a schematic plan view illustrating an example of a portion of a fluid ejection device.

FIG. 6 is a schematic plan view illustrating an example of a portion of a fluid ejection device 600. Similar to fluid ejection device 200, fluid ejection device 600 includes a first fluid ejection chamber 602 with a corresponding drop ejecting element 604, and a second fluid ejection chamber 603 with a corresponding drop ejecting element 605, such that nozzle openings or orifices 612 and 613 communicate with respective fluid ejection chambers 602 and 603. In addition, in one example, fluid ejection device 600 includes a fluid circulation path or channel 620 with a corresponding fluid circulating element 622, with fluid circulation channel 620 including a path or channel portion 630 communicated with and extended between fluid feed slot 608 and fluid ejection chamber 603, and a path or channel portion 632 communicated with and extended between fluid ejection chamber 603 and fluid ejection chamber 602.

Similar to fluid circulation channel 220 of fluid ejection device 200, fluid circulation channel 620 of fluid ejection device 600 forms a fluid circulation (or recirculation) loop between fluid feed slot 608, fluid ejection chamber 603, and fluid ejection chamber 602. For example, fluid from fluid feed slot 608 circulates (or recirculates) through fluid circulation channel 620, through fluid ejection chamber 603, and through fluid ejection chamber 602 back to fluid feed slot 608. More specifically, fluid from fluid feed slot 608 circulates (or recirculates) through channel portion 630, through fluid ejection chamber 603, through channel portion 632, and through fluid ejection chamber 602 back to fluid feed slot 608. In one example, and similar to channel portion 230 of fluid ejection device 200, channel portion 630 includes a channel loop 631 wherein channel loop 631 includes a U-shaped portion of fluid circulation channel 620.

As illustrated in the example of FIG. 6, channel portion 632 of fluid circulation channel 620 includes a "long" or "extended length" path (as compared, for example, to channel portion 232 of fluid circulation channel 220). For example, as illustrated in FIG. 6, channel portion 632 communicates with fluid ejection chamber 603 at side 603*b* and communicates with fluid ejection chamber 602 at side 602*b* such that a length of channel portion 632 between fluid ejection chamber 603 and fluid ejection chamber 602 is increased. In one example, increasing the length of channel portion 632 between fluid ejection chamber 603 and fluid ejection chamber 602 helps to "de-couple" fluid ejection chamber 603 from fluid ejection chamber 602 and mitigate cross-talk between fluid ejection chamber 603 and fluid ejection chamber 602.

Figure 7:
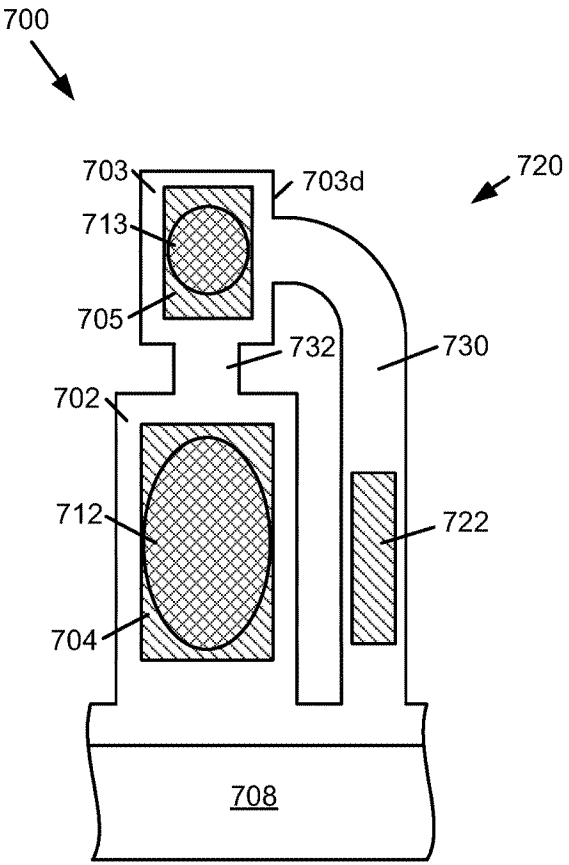
FIG. 7 is a schematic plan view illustrating an example of a portion of a fluid ejection device.

FIG. 7 is a schematic plan view illustrating an example of a portion of a fluid ejection device 700. Similar to fluid ejection device 200, fluid ejection device 700 includes a first fluid ejection chamber 702 with a corresponding drop ejecting element 704, and a second fluid ejection chamber 703 with a corresponding drop ejecting element 705, such that nozzle openings or orifices 712 and 713 communicate with respective fluid ejection chambers 702 and 703. In addition, in one example, fluid ejection device 700 includes a fluid circulation path or channel 720 with a corresponding fluid circulating element 722, with fluid circulation channel 720 including a path or channel portion 730 communicated with and extended between fluid feed slot 708 and fluid ejection chamber 703, and a path or channel portion 732 communicated with and extended between fluid ejection chamber 703 and fluid ejection chamber 702.

Similar to fluid circulation channel 220 of fluid ejection device 200, fluid circulation channel 720 of fluid ejection device 700 forms a fluid circulation (or recirculation) loop between fluid feed slot 708, fluid ejection chamber 703, and fluid ejection chamber 702. For example, fluid from fluid feed slot 708 circulates (or recirculates) through fluid circulation channel 720, through fluid ejection chamber 703, and through fluid ejection chamber 702 back to fluid feed slot 708. More specifically, fluid from fluid feed slot 708 circulates (or recirculates) through channel portion 730, through fluid ejection chamber 703, through channel portion 732, and through fluid ejection chamber 702 back to fluid feed slot 708.

As illustrated in the example of FIG. 7, nozzle opening or orifice 712 is a non-circular bore. In addition, in one example, channel portion 730 of fluid circulation channel 720 is a "short" or "direct length" path (as compared, for example, to channel loop 231 of fluid circulation channel 220). For example, as illustrated in FIG. 7, channel portion 730 communicates with fluid ejection chamber 703 at side 703*d*.

Figure 8:
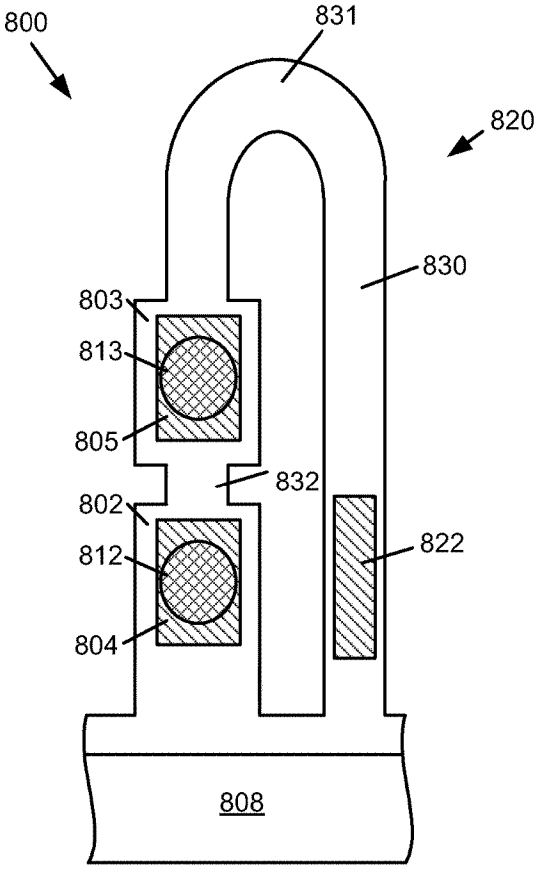
FIG. 8 is a schematic plan view illustrating an example of a portion of a fluid ejection device.

FIG. 8 is a schematic plan view illustrating an example of a portion of a fluid ejection device 800. Similar to fluid ejection device 200, fluid ejection device 800 includes a first fluid ejection chamber 802 with a corresponding drop ejecting element 804, and a second fluid ejection chamber 803 with a corresponding drop ejecting element 805, such that nozzle openings or orifices 812 and 813 communicate with respective fluid ejection chambers 802 and 803. In addition, in one example, fluid ejection device 800 includes a fluid circulation path or channel 820 with a corresponding fluid circulating element 822, with fluid circulation channel 820 including a path or channel portion 830 communicated with and extended between fluid feed slot 808 and fluid ejection chamber 803, and a path or channel portion 832 communicated with and extended between fluid ejection chamber 803 and fluid ejection chamber 802.

Similar to fluid circulation channel 220 of fluid ejection device 200, fluid circulation channel 820 of fluid ejection device 800 forms a fluid circulation (or recirculation) loop between fluid feed slot 808, fluid ejection chamber 803, and fluid ejection chamber 802. For example, fluid from fluid feed slot 808 circulates (or recirculates) through fluid circulation channel 820, through fluid ejection chamber 803, and through fluid ejection chamber 802 back to fluid feed slot 808. More specifically, fluid from fluid feed slot 808 circulates (or recirculates) through channel portion 830, through fluid ejection chamber 803, through channel portion 832, and through fluid ejection chamber 802 back to fluid feed slot 808. In one example, and similar to channel portion 230 of fluid ejection device 200, channel portion 830 includes a channel loop 831 wherein channel loop 831 includes a U-shaped portion of fluid circulation channel 820.

In one example, as illustrated in FIG. 8, nozzle openings or orifices 812 and 813 are of the same size and shape. As such, nozzle openings or orifices 812 and 813 enable the ejection of drops of the same size (weight). Accordingly, drop ejecting elements 804 and 805 may be operated separately or individually at different moments of time to produce drops of the same size (weight), or operated simultaneously to produce a combined drop of a combined size (weight).

Figure 9:
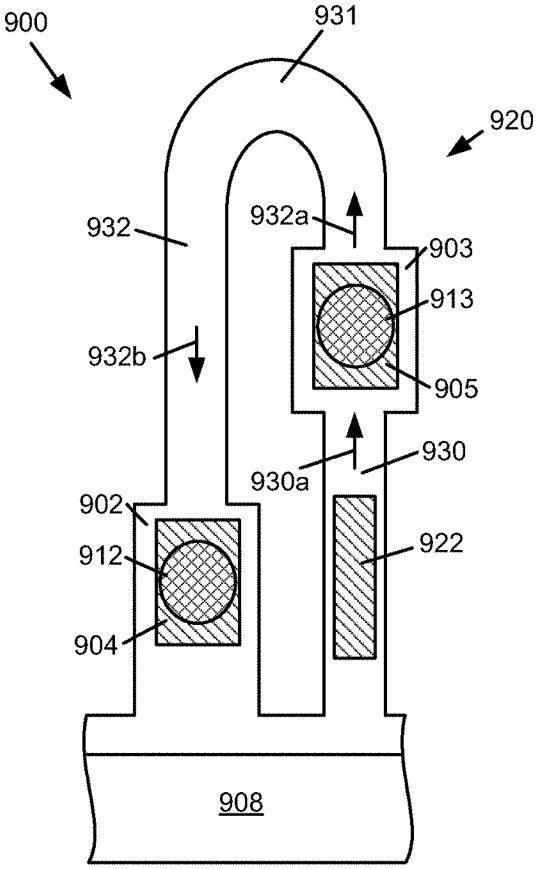
FIG. 9 is a schematic plan view illustrating an example of a portion of a fluid ejection device.

FIG. 9 is a schematic plan view illustrating an example of a portion of a fluid ejection device 900. Similar to fluid ejection device 200, fluid ejection device 900 includes a first fluid ejection chamber 902 with a corresponding drop ejecting element 904, and a second fluid ejection chamber 903 with a corresponding drop ejecting element 905, such that nozzle openings or orifices 912 and 913 communicate with respective fluid ejection chambers 902 and 903. In addition, in one example, fluid ejection device 900 includes a fluid circulation path or channel 920 with a corresponding fluid circulating element 922, with fluid circulation channel 920 including a path or channel portion 930 communicated with and extended between fluid feed slot 908 and fluid ejection chamber 903, and a path or channel portion 932 communicated with and extended between fluid ejection chamber 903 and fluid ejection chamber 902.

Similar to fluid circulation channel 220 of fluid ejection device 200, fluid circulation channel 920 of fluid ejection device 900 forms a fluid circulation (or recirculation) loop between fluid feed slot 908, fluid ejection chamber 903, and fluid ejection chamber 902. For example, fluid from fluid feed slot 908 circulates (or recirculates) through fluid circulation channel 920, through fluid ejection chamber 903, and through fluid ejection chamber 902 back to fluid feed slot 908. More specifically, fluid from fluid feed slot 908 circulates (or recirculates) through channel portion 930, through fluid ejection chamber 903, through channel portion 932, and through fluid ejection chamber 902 back to fluid feed slot 908.

In one example, channel portion 930 circulates (or recirculates) fluid in a first direction, as indicated by arrow 930*a*. In addition, channel portion 932 circulates (or recirculates) fluid in the first direction, as indicated by arrow 932*a*, and a second direction opposite the first direction, as indicated by arrow 932*b*. As such, in one example, fluid circulation channel 920 circulates fluid in a first direction (arrow 930*a*) between fluid circulating element 922 and fluid ejection chamber 903, and circulates fluid in a second direction (arrow 932*b*) opposite the first direction between fluid ejection chamber 903 and fluid ejection chamber 902, and circulates fluid in the first direction (arrow 932*a*) and the second direction (arrow 932*b*) between fluid ejection chamber 903 and fluid ejection chamber 902.

In one example, to provide fluid flow in the first direction indicated by arrow 932*a* and the second, opposite direction indicated by arrow 932*b*, channel portion 932 includes a channel loop 931. In one example, channel loop 931 includes a U-shaped portion of fluid circulation channel 920 such that a length (or portion) of channel portion 930 and a length (or portion) of channel portion 932 are spaced from and oriented substantially parallel with each other.

Similar to fluid ejection chamber 203 of fluid ejection device 200, fluid ejection chamber 903 of fluid ejection device 900 is provided in, provided along, or communicated with fluid circulation channel 920 between fluid circulating element 922 and fluid ejection chamber 902. However, compared to fluid circulation channel 220 of fluid ejection device 200, a length of channel portion 932 of fluid circulation channel 920 between fluid ejection chamber 903 and fluid ejection chamber 902 is increased such that a length of channel portion 932 is greater than a length of channel portion 930.

In addition, with fluid circulation channel 920, fluid ejection chamber 903 is provided at an "upstream" side of channel loop 931 (relative to a direction of fluid flow from fluid feed slot 908 through channel portion 930, through fluid ejection chamber 903, through channel portion 932, and through fluid ejection chamber 902 back to fluid feed slot 908), as compared to fluid ejection chamber 203 of fluid ejection device 200 which is provided at a "downstream" side of channel loop 231. As such, in one example, increasing the length of channel portion 932, such that the distance between fluid ejection chamber 903 and fluid ejection chamber 902 is increased, and providing fluid ejection chamber 903 at an "upstream" side of channel loop 931, helps to "de-couple" fluid ejection chamber 903 from fluid ejection chamber 902 and mitigate cross-talk between fluid ejection chamber 903 and fluid ejection chamber 902.

Figure 10:
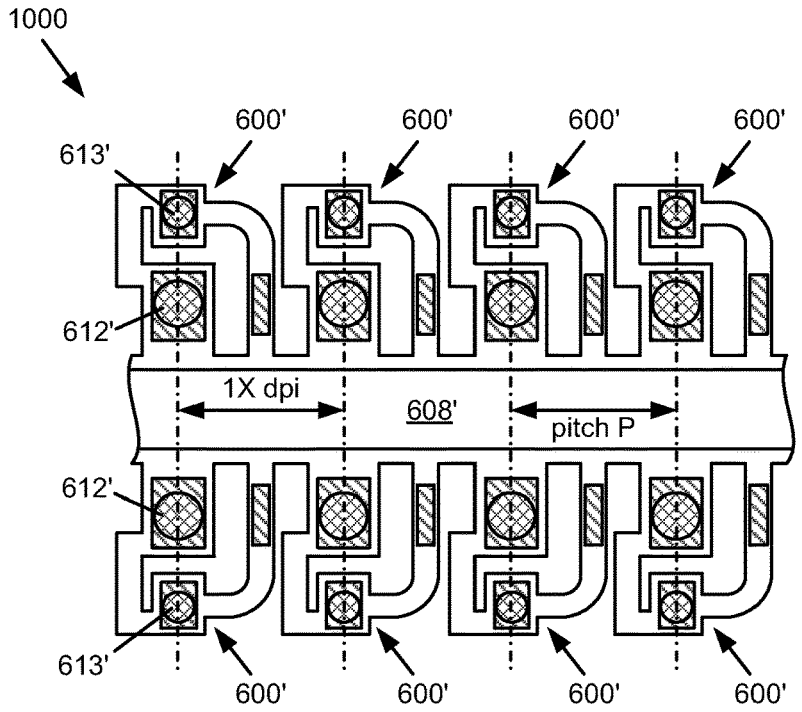
FIG. 10 is a schematic plan view illustrating an example of a portion of a fluid ejection device.

FIG. 10 is a schematic plan view illustrating an example of a portion of a fluid ejection device 1000. In one example, fluid ejection device 1000 includes an array of fluid ejection devices, such as an array of fluid ejection devices 600' similar to fluid ejection devices 600, as illustrated in FIG. 6 and described above, with fluid ejection devices 600' including, for example, a "short" or "direct length" path or channel portion similar to channel portion 730 between fluid feed slot 708 and fluid ejection chamber 703 (FIG. 7) rather than U-shaped channel portion 630 between fluid feed slot 608 and fluid ejection chamber 603 (FIG. 6). In one example, fluid ejection devices 600' are arranged on opposite sides of fluid feed slot 608' such that corresponding nozzle openings or orifices 612' and 613' of fluid ejection devices 600' are arranged in parallel (substantially parallel) columns (or arrays).

In one example, fluid ejection devices 600' of fluid ejection device 1000 are evenly arranged, or are an equal distance apart from one another, along a length of fluid feed slot 608'. More specifically, in one example, adjacent nozzle openings or orifices 612' and 613' are spaced at a distance or pitch P. As illustrated in the example of FIG. 10, fluid ejection devices 600' on opposite sides of fluid feed slot 608' are aligned relative to each other to define a dpi (dots-per-inch) grid of 1×.

Figure 11:
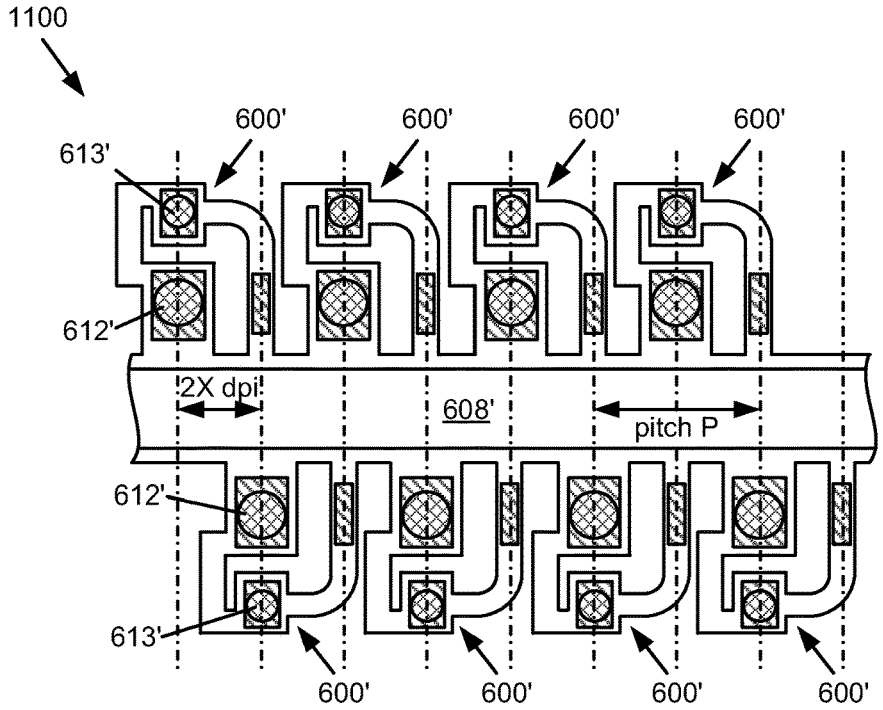
FIG. 11 is a schematic plan view illustrating an example of a portion of a fluid ejection device.

FIG. 11 is a schematic plan view illustrating an example of a portion of a fluid ejection device 1100. In one example, similar to fluid ejection device 1000, fluid ejection device 1100 includes an array of fluid ejection devices, such as an array of fluid ejection devices 600' similar to fluid ejection devices 600, as illustrated in FIG. 6 and described above, with fluid ejection devices 600' including, for example, a "short" or "direct length" path or channel portion similar to channel portion 730 between fluid feed slot 708 and fluid ejection chamber 703 (FIG. 7) rather than U-shaped channel portion 630 between fluid feed slot 608 and fluid ejection chamber 603 (FIG. 6). In one example, fluid ejection devices 600' are arranged on opposite sides of fluid feed slot 608' such that corresponding nozzle openings or orifices 612' and 613' of fluid ejection devices 600' are arranged in parallel (substantially parallel) columns (or arrays).

In one example, fluid ejection devices 600' of fluid ejection device 1100 are evenly arranged, or are an equal distance apart from one another, along a length of fluid feed slot 608'. More specifically, in one example, adjacent nozzle openings or orifices 612' and 613' are spaced at a distance or pitch P. As illustrated in the example of FIG. 11, fluid ejection devices 600' on opposite sides of fluid feed slot 608' are offset and interleaved relative to each other to define a dpi (dots-per-inch) grid of 2×.

Figure 12:
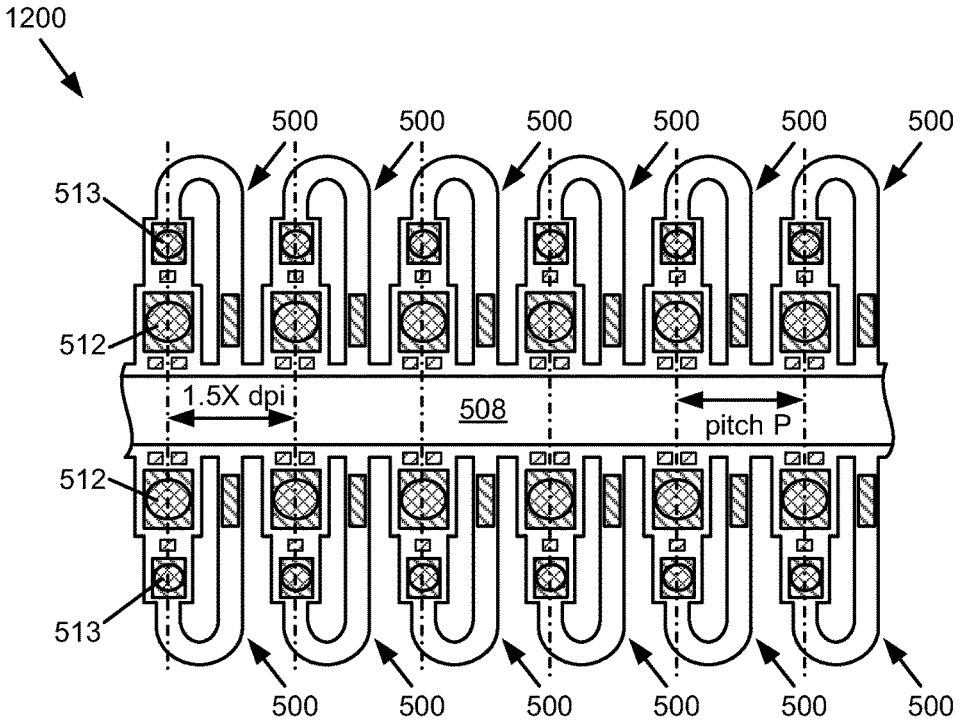
FIG. 12 is a schematic plan view illustrating an example of a portion of a fluid ejection device.

FIG. 12 is a schematic plan view illustrating an example of a portion of a fluid ejection device 1200. In one example, fluid ejection device 1200 includes an array of fluid ejection devices, such as an array of fluid ejection devices 500, as illustrated in FIG. 5 and described above. In one example, fluid ejection devices 500 are arranged on opposite sides of fluid feed slot 508 such that corresponding nozzle openings or orifices 512 and 513 of fluid ejection devices 500 are arranged in parallel (substantially parallel) columns (or arrays).

In one example, fluid ejection devices 500 of fluid ejection device 1200 are evenly arranged, or are an equal distance apart from one another, along a length of fluid feed slot 508. More specifically, in one example, adjacent nozzle openings or orifices 512 and 513 are spaced at a distance or pitch P. As illustrated in the example of FIG. 12, fluid ejection devices 500 on opposite sides of fluid feed slot 508 are aligned relative to each other to define a dpi (dots-per-inch) grid of 1.5×.

Figure 13:
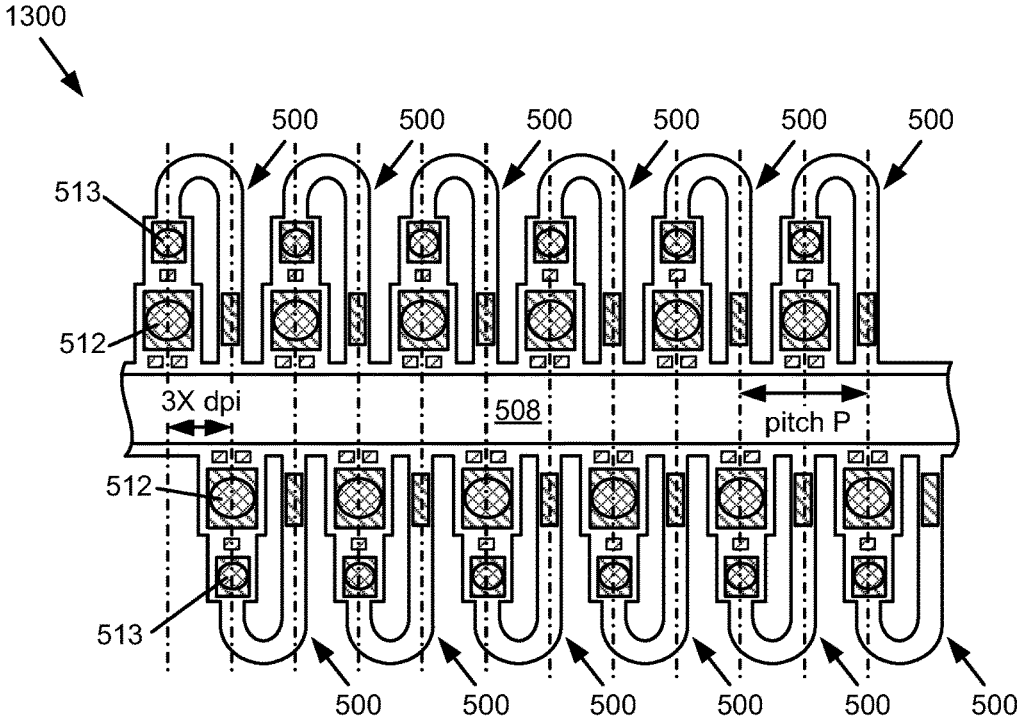
FIG. 13 is a schematic plan view illustrating an example of a portion of a fluid ejection device.

FIG. 13 is a schematic plan view illustrating an example of a portion of a fluid ejection device 1300. In one example, similar to fluid ejection device 1200, fluid ejection device 1300 includes an array of fluid ejection devices, such as an array of fluid ejection devices 500, as illustrated in FIG. 5 and described above. In one example, fluid ejection devices 500 are arranged on opposite sides of fluid feed slot 508 such that corresponding nozzle openings or orifices 512 and 513 of fluid ejection devices 500 are arranged in parallel (substantially parallel) columns (or arrays).

In one example, fluid ejection devices 500 of fluid ejection device 1300 are evenly arranged, or are an equal distance apart from one another, along a length of fluid feed slot 508. More specifically, in one example, adjacent nozzle openings or orifices 512 and 513 are spaced at a distance or pitch P. As illustrated in the example of FIG. 13, fluid ejection devices 500 on opposite sides of fluid feed slot 508 are offset and interleaved relative to each other to define a dpi (dots-per-inch) grid of 3×.

Figure 14:
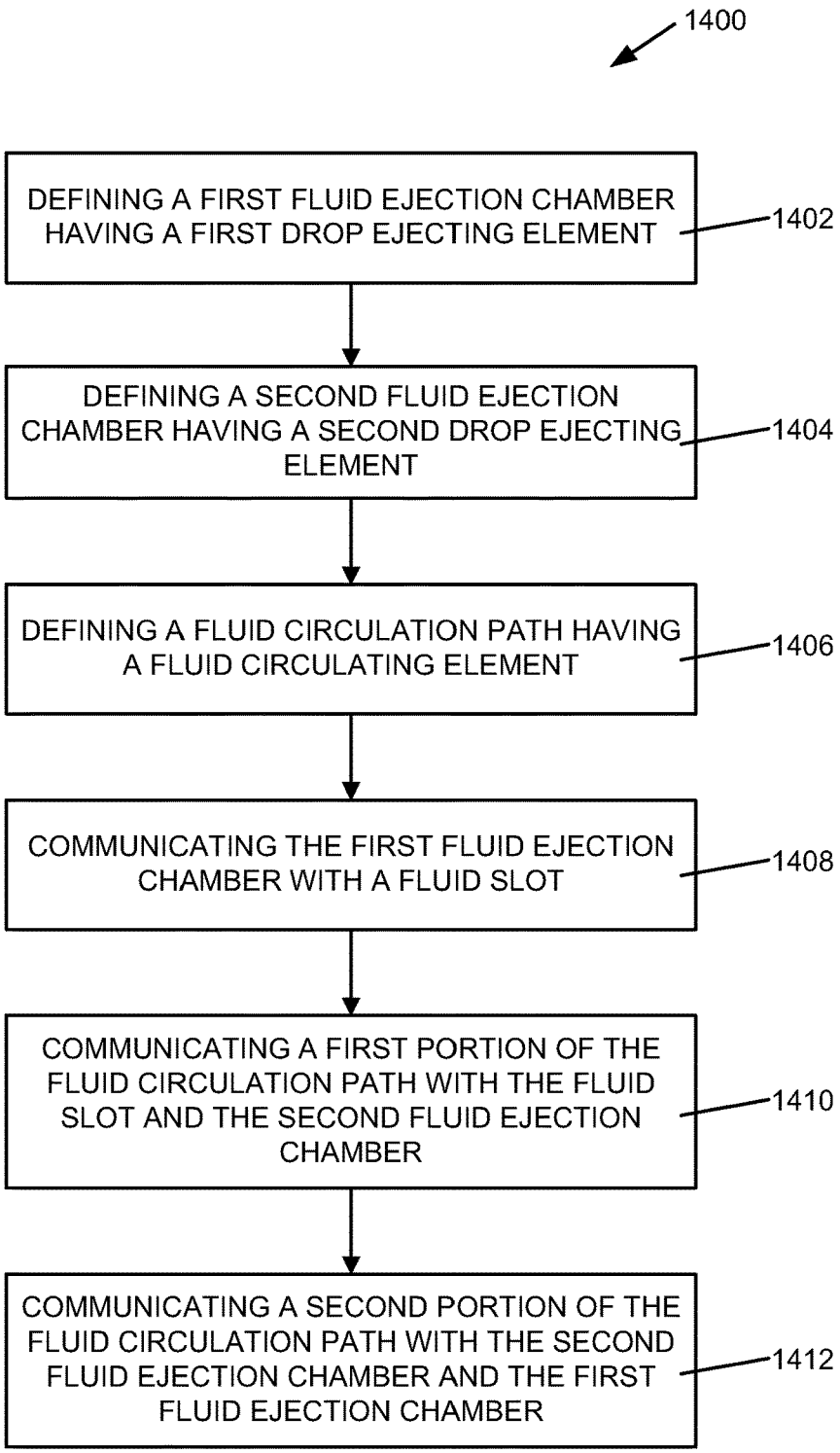
FIG. 14 is a flow diagram illustrating an example of a method of forming a fluid ejection device.

FIG. 14 is a flow diagram illustrating an example of a method 1400 of forming a fluid ejection device, such as fluid ejection device 200, 300, 400, 500, 600, 700, 800, 900 as illustrated in the respective examples of FIGS. 2, 3, 4, 5, 6, 7, 8, 9.

At 1402, method 1400 includes defining a first fluid ejection chamber having a first drop ejecting element, such as fluid ejection chambers 202, 302, 402, 502, 602, 702, 802, 902 having respective drop ejecting elements 204, 304, 404, 504, 604, 704, 804, 904.

At 1404, method 1400 includes defining a second fluid ejection chamber having a second drop ejecting element, such as fluid ejection chambers 203, 303, 403, 503, 603, 703, 803, 903 having respective drop ejecting elements 205, 305, 405, 505, 605, 705, 805, 905.

At 1406, method 1400 includes defining a fluid circulation path having a fluid circulating element, such as fluid circulation paths or channels 220, 320, 420, 520, 620, 720, 820, 920 having fluid circulating elements 222, 322, 422, 522, 622, 722, 822, 922.

At 1408, method 1400 includes communicating the first fluid ejection chamber with a fluid slot, such as fluid ejection chambers 202, 302, 402, 502, 602, 702, 802, 902 with respective fluid feed slots 208, 308, 408, 508, 608, 708, 808, 908.

At 1410, method 1400 includes communicating a first portion of the fluid circulation path with the fluid slot and the second fluid ejection chamber, such as path or channel portions 230, 330, 430, 530, 630, 730, 830, 930 with respective fluid feed slots 208, 308, 408, 508, 608, 708, 808, 908 and respective fluid ejection chambers 203, 303, 403, 503, 603, 703, 803, 903.

At 1412, method 1400 includes communicating a second portion of the fluid circulation path with the second fluid ejection chamber and the first fluid ejection chamber, such as path or channel portions 232, 332, 432, 532, 632, 732, 832, 932 with respective fluid ejection chambers 203, 303, 403, 503, 603, 703, 803, 903 and respective fluid ejection chambers 202, 302, 402, 502, 602, 702, 802, 902.

Although illustrated and described as separate and/or sequential steps, the method of forming the fluid ejection device may include a different order or sequence of steps, and may combine one or more steps or perform one or more steps concurrently, partially or wholly.

Although specific examples have been illustrated and described herein, it will be appreciated by those of ordinary skill in the art that a variety of alternate and/or equivalent implementations may be substituted for the specific examples shown and described without departing from the scope of the present disclosure. This application is intended to cover any adaptations or variations of the specific examples discussed herein.

The invention claimed is:

1. A fluid ejection device, comprising:

a fluid slot;

a first fluid ejection chamber communicated with the fluid slot and including a first drop ejecting element;

a second fluid ejection chamber including a second drop ejecting element; and a fluid circulation path having a first end communicated with the fluid slot, and a second end communicated with the fluid slot, the fluid circulation path including a fluid circulating element to induce a flow of circulating fluid in the fluid circulation path, wherein the fluid circulating element, the first fluid ejection chamber, and the second fluid ejection chamber are arranged in series in the fluid circulation path between the first and second ends of the fluid circulation path.

2. The fluid ejection device of claim 1, wherein the fluid circulation path includes a first segment including the fluid circulating element, a second segment including the first and second fluid ejection chambers, and a channel loop between the first and second segments.

3. A fluid ejection device, comprising:

a fluid slot;

a first fluid ejection chamber communicated with the fluid slot;

a first drop ejecting element within the first fluid ejection chamber;

a fluid circulation path communicated at a first end and at a second end with the fluid slot;

a fluid circulating element within the fluid circulation path;

a second fluid ejection chamber arranged in series with the fluid circulation element and the first fluid ejection chamber in the fluid circulation path between the first and second ends of the fluid circulation path; and a second drop ejecting element within the second fluid ejection chamber.

4. The fluid ejection device of claim 3, wherein the fluid circulation path is to circulate fluid communicated between the fluid circulating element and the second fluid ejection chamber in a first direction, and the fluid circulation path is to circulate fluid communicated between the second fluid ejection chamber and the first fluid ejection chamber in a second direction opposite the first direction.

5. The fluid ejection device of claim 4, wherein the fluid circulation path is to circulate fluid in the first direction and the second direction between the fluid circulating element and the second fluid ejection chamber.

6. The fluid ejection device of claim 4, wherein the fluid circulation path is to circulate fluid in the first direction and the second direction between the second fluid ejection chamber and the first fluid ejection chamber.

7. The fluid ejection device of claim 3, wherein the fluid circulation path includes a first portion extended between the fluid slot and the second fluid ejection chamber, and a second portion extended between the second fluid ejection chamber and the first fluid ejection chamber, and wherein a flow of circulating fluid induced by the fluid circulating element is from the first end to the fluid circulating element, and from the fluid circulating element to the second fluid ejection chamber, and from the second fluid ejection chamber to the first fluid ejection chamber, and from the first fluid ejection chamber to the second end.

8. The fluid ejection device of claim 3, further comprising:

a particle tolerant architecture within the fluid circulation path between the first fluid ejection chamber and the second fluid ejection chamber, the particle tolerant architecture comprising a structure to block a particle from flowing from the second fluid ejection chamber to the first fluid ejection chamber.

9. A method of forming a fluid ejection device, comprising:

defining a first fluid ejection chamber having a first drop ejecting element;

defining a second fluid ejection chamber having a second drop ejecting element;

defining a fluid circulation path having a fluid circulating element;

communicating a first end and a second end of the fluid circulation path with a fluid slot; and arranging the fluid circulating element, the first fluid ejection chamber, and the second fluid ejection chamber in series in the fluid circulation path between the first and second ends of the fluid circulation path.

10. The fluid ejection device of claim 1, wherein the fluid circulating element is separate from each of the first and second fluid ejecting chambers.

11. The fluid ejection device of claim 1, further comprising a particle tolerant architecture in a portion of the fluid circulation path between the first and second fluid ejection chambers, the particle tolerant architecture comprising a structure to block a particle from flowing from the second fluid ejection chamber to the first fluid ejection chamber.

12. The fluid ejection device of claim 2, wherein the circulating fluid is to flow in a first direction in the first segment, and to flow in a second direction opposite the first direction in the second segment, and wherein the circulating fluid is to flow in the second direction between the first and second fluid ejection chambers.

13. The fluid ejection device of claim 1, further comprising:

a first orifice through which a fluid drop is ejected in response to activation of the first drop ejecting element; and a second orifice through which a fluid drop is ejected in response to activation of the second drop ejecting element, wherein the second orifice has a size different from a size of the first orifice.

14. The fluid ejection device of claim 1, wherein the circulating fluid is to flow from the first end to the fluid circulating element, and from the fluid circulating element to the second fluid ejection chamber, and from the second fluid ejection chamber to the first fluid ejection chamber, and from the first fluid ejection chamber to the second end.

15. The fluid ejection device of claim 3, wherein the fluid circulating element is separate from each of the first and second fluid ejecting chambers.

16. The fluid ejection device of claim 15, wherein the fluid circulating element comprises an actuator to pump fluid in the fluid circulation path.

17. The fluid ejection device of claim 3, further comprising:

a first orifice through which a fluid drop is ejected in response to activation of the first drop ejecting element; and a second orifice through which a fluid drop is ejected in response to activation of the second drop ejecting element, wherein the second orifice has a size different from a size of the first orifice.

18. The fluid ejection device of claim 4, wherein the fluid circulation path is to direct fluid from the fluid circulating element into the second fluid ejection chamber along the second direction.

19. The method of claim 9, further comprising:

forming a channel loop in the fluid circulation path between a first fluid circulation path segment including the fluid circulating element, and a second fluid circulation path segment including the first and second fluid ejection chambers.

20. The method of claim 9, wherein a flow of circulating fluid induced by the fluid circulation element is from the first end to the fluid circulating element, and from the fluid circulating element to the second fluid ejection chamber, and from the second fluid ejection chamber to the first fluid ejection chamber, and from the first fluid ejection chamber to the second end.

* * * * *